US007128251B1

(12) United States Patent
Galle

(10) Patent No.: US 7,128,251 B1
(45) Date of Patent: Oct. 31, 2006

(54) STACKABLE BAG ROLL DISPENSING SYSTEM

(75) Inventor: Francis B. Galle, Metairie, LA (US)

(73) Assignee: Advance Polybag, Inc., Houston, TX (US)

( * ) Notice: Subject to any disclaimer, the term of this patent is extended or adjusted under 35 U.S.C. 154(b) by 250 days.

(21) Appl. No.: 10/607,437

(22) Filed: Jun. 26, 2003

(51) Int. Cl.
*B26F 3/00* (2006.01)
*B65H 49/20* (2006.01)

(52) U.S. Cl. ..... 225/2; 225/39; 225/106; 221/45

(58) Field of Classification Search ..... 225/106, 225/39, 42, 46, 52, 2; 221/45, 48, 50, 51, 221/63, 1; 206/389, 390, 407; 242/598, 242/598.2, 598.1, 85
See application file for complete search history.

(56) References Cited

U.S. PATENT DOCUMENTS

| | | | | | |
|---|---|---|---|---|---|
| 408,752 | A * | 8/1889 | Ross | 225/71 |
| 2,334,825 | A * | 11/1943 | Jones | 211/126.2 |
| 3,045,883 | A * | 7/1962 | Andrews et al. | 225/90 |
| 3,349,991 | A | 10/1967 | Kessier | |
| 3,741,403 | A * | 6/1973 | Fleischer et al. | 211/135 |
| 4,094,416 | A * | 6/1978 | Smith | 211/85.28 |
| 4,685,633 | A * | 8/1987 | Pellini | 242/598.3 |
| 5,135,134 | A | 8/1992 | Dancy | |
| 5,135,146 | A | 8/1992 | Simhaee | |
| 5,209,371 | A * | 5/1993 | Daniels | 221/63 |
| 5,480,084 | A | 1/1996 | Daniels | |
| 5,636,809 | A * | 6/1997 | Koch | 242/422.5 |
| 5,706,993 | A | 1/1998 | DeMatteis | |
| 5,727,721 | A * | 3/1998 | Guido et al. | 225/106 |
| 5,813,585 | A | 9/1998 | Kannankeril et al. | |
| 5,934,535 | A * | 8/1999 | Kannankeril et al. | 225/106 |
| 5,944,280 | A * | 8/1999 | Dimitri | 242/594.2 |
| 6,279,806 | B1 * | 8/2001 | Simhaee | 225/106 |
| 6,305,572 | B1 | 10/2001 | Daniels et al. | |
| 6,431,396 | B1 | 8/2002 | Daniels et al. | |
| 6,450,380 | B1 * | 9/2002 | Simhaee | 225/46 |
| 6,481,594 | B1 * | 11/2002 | Yeh et al. | 221/63 |
| 6,685,075 | B1 * | 2/2004 | Kannankeril | 225/96 |
| 6,974,060 | B1 * | 12/2005 | Gomes et al. | 225/34 |

* cited by examiner

*Primary Examiner*—Boyer D. Ashley
*Assistant Examiner*—Omar Flores Sánchez
(74) *Attorney, Agent, or Firm*—Joseph T. Regard Ltd plc

(57) ABSTRACT

A system for dispensing thermoplastic bags or the like from a roll of bags. The present system is configured for point of use dispensing to a customer, such as in the produce section of a grocery store or market. The preferred, exemplary embodiment of the present system teaches a bag dispensing rack configured to hold a single roll of produce bags, but which is configured to provide an interlocking system for stacking multiple racks of bags one upon the other, each rack holding a single roll of bags, which may be of different configurations or sizes. Each bag pack is dispensed from a roll which includes first and second retaining side walls, a base, and a front opening terminating in a dispensing tongue, which is configured to engage an open slit situated medially relative to a perforated dispenser line juxtaposed each bag forming the bag roll. Further contemplated is a unique roll supporting surface configuration wherein the roll is saddled, providing easy installation of the system within the rack, while facilitating braking of the bag roll during dispensing so as to prevent over spooling during the dispensing process.

2 Claims, 7 Drawing Sheets

STACKABLE BAG ROLL DISPENSING SYSTEM

TECHNICAL FIELD OF THE INVENTION

The present invention relates to bag dispensing systems, and particularly to a system for dispensing thermoplastic bags or the like from a roll of bags. The present system is configured for point of use dispensing to a customer, such as in the produce section of a grocery store or market.

The preferred, exemplary embodiment of the present system teaches a bag dispensing rack configured to hold a single roll of produce bags, but which is configured to provide an interlocking system for stacking multiple racks of bags one upon the other, each rack holding a single roll of bags, which may be of different configurations or sizes. Each bag pack is dispensed from a roll which includes first and second retaining side walls, a base, and a front opening terminating in a dispensing tongue, which is configured to engage an open slit situated medially relative to a perforated dispenser line juxtaposed each bag forming the bag roll.

Further contemplated is a unique roll supporting surface configuration wherein the roll is saddled, providing easy installation of the system within the rack, while facilitating braking of the bag roll during dispensing so as to prevent over spooling during the dispensing process.

Still further contemplated is a separate base for mounting of the rack thereupon, which the upper or lower end of the rack is configured to engage, depending upon whether the rack is to be supported overhead or below, respectively. The opposing ends of the rack are likewise configured to engage the opposing end of another rack, so as to facilitate stable support of two or more racks in a vertical profile.

BACKGROUND OF THE INVENTION

Produce bags are dispensed directly to customers at produce counters or the like, where the customer can bag the produce as it is chosen for purchase. A common problem with dispensing produce bags is providing the bag to the consumer in a convenient, simple, and reliable fashion. Further considerations relate to ease of replenishing the supply, uniformity of dispensing, ease of opening, and providing closure means such as bag ties or the like. Prior art patents have contemplated various dispensers for produce bags, including rolls of unfolded or folded bags, dispensing boxes, and stands, which may be wall mounted for free standing.

U.S. Pat. No. 5,135,146 entitled "plastic bag dispenser" sets forth a system for dispensing bags from a roll having an axle, which is supported in a slot. A "finger" is provided on the upstream side of the tongue with a gap therebetween for receiving a portion of the next bag to be dispensed, temporarily anchoring same in a convenient location for access by the user.

U.S. Pat. No. 3,349,991 issued 1967 illustrates a gussetted bag having a lengthwise fold and sealed at the base to form a star seal, similar to the fold and bottom seal of the exemplary embodiment of the bags forming the roll in the present system.

U.S. Pat. No. 5,135,134 issued 1992 teaches a dispenser for dispensing a roll of plastic bags, each of the bags having situated therebetween a perforated tear line having a medial slot for engaging a tongue (28) emanating from the dispenser, such that the tongue engages the slot as a bag is being removed, causing said perforated tear line to tear, disconnecting the bag being dispensed from the remainder of the roll.

GENERAL SUMMARY DISCUSSION OF THE INVENTION

Unlike the prior art, the present invention provides a bag dispenser system which is comparatively strong and reliable, while being inexpensive to manufacture, requiring little in the way of custom manufacturing equipment, while being consistent in performance and quality.

Prior art systems for produce bag dispensers for dispensing individual bags from a pack of bags are found to have shortcomings relating to the expense of manufacture and the ease of use. Specialized racks were designed for dispensing certain types of bag rolls, some requiring axles extending beyond the rolls, others requiring specialized slit configurations for engaging relatively complicated detachment and anchoring apparatus.

None of these prior art systems were believed configured to provide an easily stackable system, nor were they configured to dispense a variety of bag types, whether produce bags, t-shirt bags, or the like.

The present system provides a new and innovative, yet relatively uncomplicated and straightforward, system for dispensing a variety of configuration bag rolls in a stackable configuration, allowing diverse installation possibilities.

In the present invention, a single base unit is installed, upon with can be stacked one or more nesting racks for receiving and dispensing bag rolls. Thus, a customized "dispensing station" can be configured on a small footprint for every need at the point of use, whether it be a simple single roll dispenser, or multiple, diverse stacked racks with various alternative bags for selection and use by the customer. Still further, one may easily provide multiple stacked identical racks on a small footprint for dispensing the same size and configuration bag in high demand areas.

The persent system further provides a unique configuration for rear feeding of whole bag rolls into a feeder from the rear while in a stacked configuration.

It is therefore an object of the present invention to provide an improved system for dispensing individual thermoplastic bags or the like.

It is another object of the present invention to provide a system for dispensing a roll of bags having a perforated dispensing line situated therebetween having a slot situated medially therein, which includes a simple yet effective means of preventing roll over-spin during dispensing.

It is still another object of the present invention to provide a bag dispensing system which requires little significant equipment modification, while providing a consistent quality, strong and aesthetically acceptable product.

It is another object of the present invention to provide a bag rack which includes lockable, stackable upper and lower portions for mounting to a base at one end and receiving and supporting a second rack at the other.

Lastly, it is an object of the present invention to provide a bag rack which easily and quickly receives a bag roll, providing a consistent and reliable dispenser for produce bags or the like.

BRIEF DESCRIPTION OF DRAWINGS

For a further understanding of the nature and objects of the present invention, reference should be had to the following detailed description, taken in conjunction with the accompanying drawings, in which like parts are given like reference numerals, and wherein.

DETAILED DISCUSSION OF THE INVENTION

Figure 1:
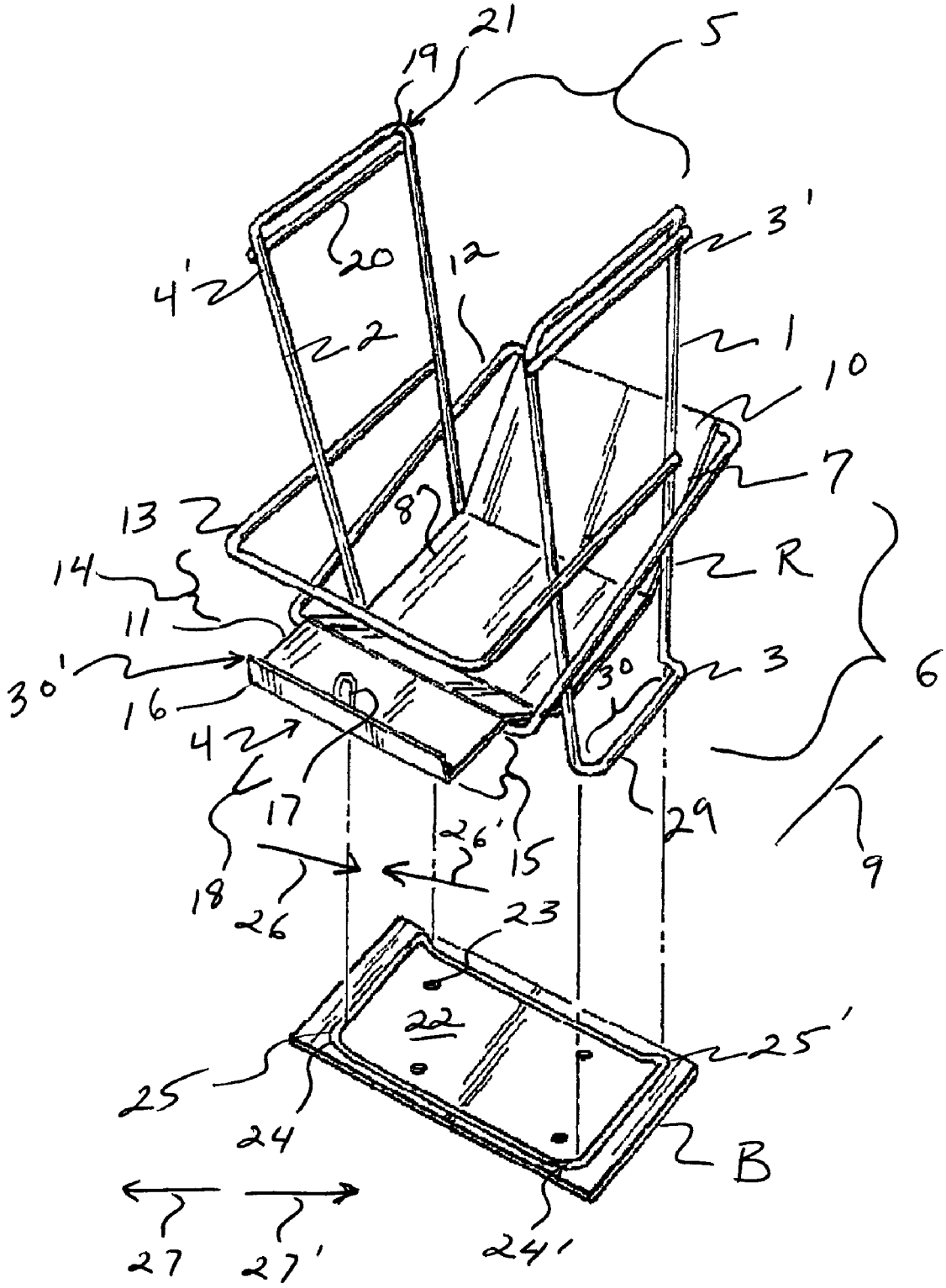
FIG. 1 is an isometric view of the preferred embodiment of the rack of the present invention separated from the mounting base.
Figure 2:
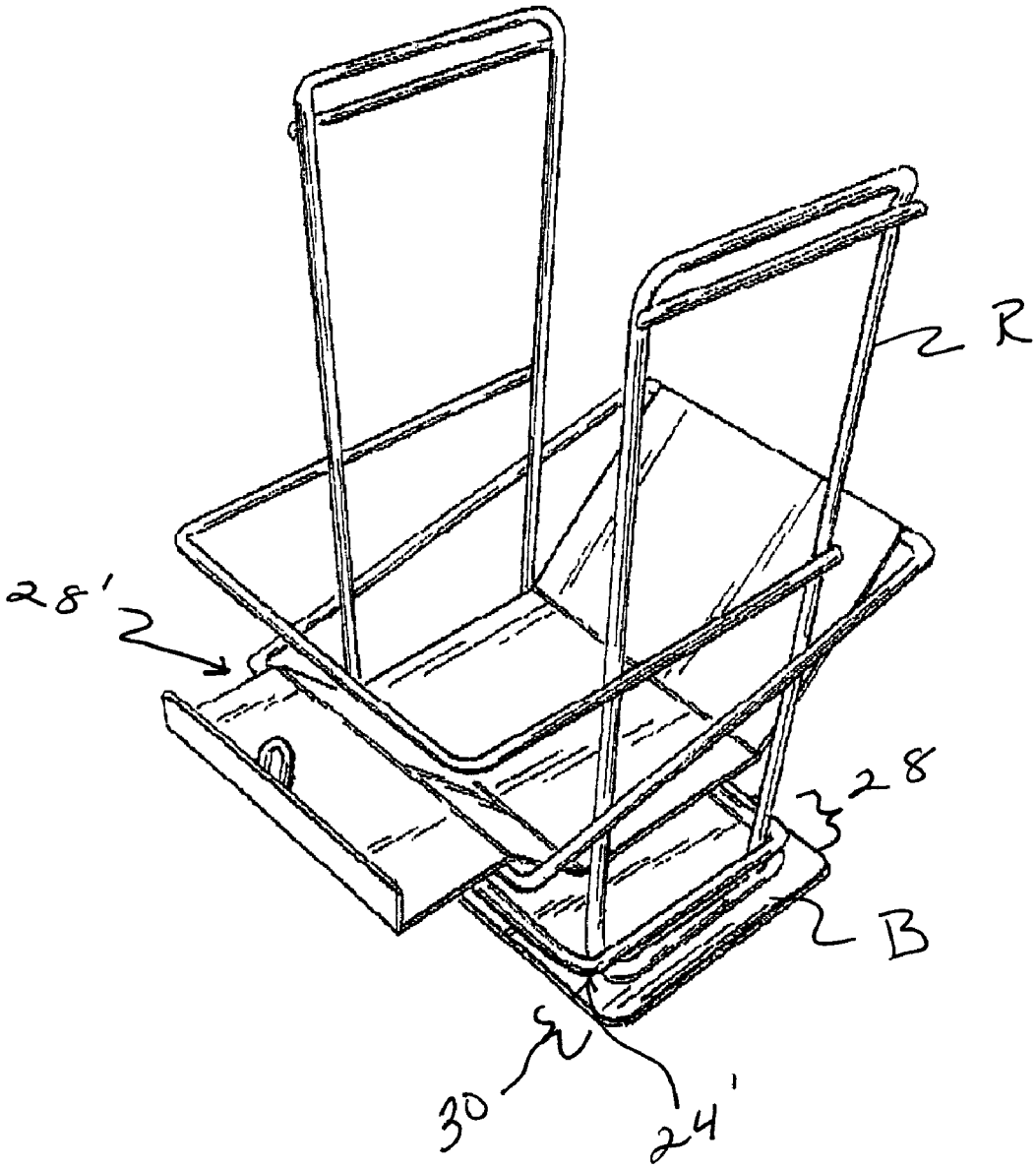
FIG. 2 is an isometric view of the rack of FIG. 1 engaged to the mounting base.

Referring to FIGS. 1 and 2 of the drawings, the rack R of the present invention comprises first 1 and second 2 vertical support members, each having upper 4', 3' and lower 4, 3 ends, and a space therebetween 5 for receiving a cradle 6 for supporting a bag roll.

The cradle 6 is formed from a base plate 7 for supporting the bag roll, the base plate having a medial portion 8 having a generally horizontal 9 configuration, a rear angled portion 10, and a front, elevated dispenser portion 11, above which, situated in spaced relationship 14, is found a stop bar 13 for limiting forward migration of the bag roll during dispensing, as will be further discussed below. The base plate 7 is further supported, and the cradle 6 further partially enclosed by, a support member 12 encompassing the base plate.

An extension 15 is provided forward the rack R, the extension having an end 16 distal the rack, having a tongue 17 emanating generally vertically therefrom in medially situated 18 fashion.

A curved mounting bracket 19 is provided at the upper 3, 3' ends of each of the first 1 and second 2 vertical support members, respectively, each mounting bracket 19 formed by opposing outward bends in the material forming the piece, and a support bar 20 situated thereunder to form an engagement slot 21.

The lower 3, 4 ends of the first 1 and second 2 vertical supports have opposing curved engagement sections 29 outwardly situated relative to one another to form first 30 and second 30' mounting flanges.

The mounting base B is formed of a mounting plate 22 having apertures 23 for receiving threaded fasteners, rivets or the like to mount the unit to a fixed surface or support bracket, the mounting plate having first and second ends having first 24 and second 24' engagement slots formed by brackets 25, 25', respectively, which slots are configured to receive and engage the first 30 and second 30' mounting flanges formed at the lower 3,4 ends of the first 1 and second 2 vertical supports, respectively, by directing 26, 26' the lower ends 3, 4 of the vertical supports toward one another so that the first 30 and second 30' mounting flanges fit between the first 24 and second 24' mounting slots, and releasing the first 24 and second 24' ends, which allows the ends to spring 27, 27' back to parallel position, such that the mounting flanges 30, 30' slide into and engage the slots 25, 25', engaging same and realizable locking the rack R to the base B.

Figure 3:
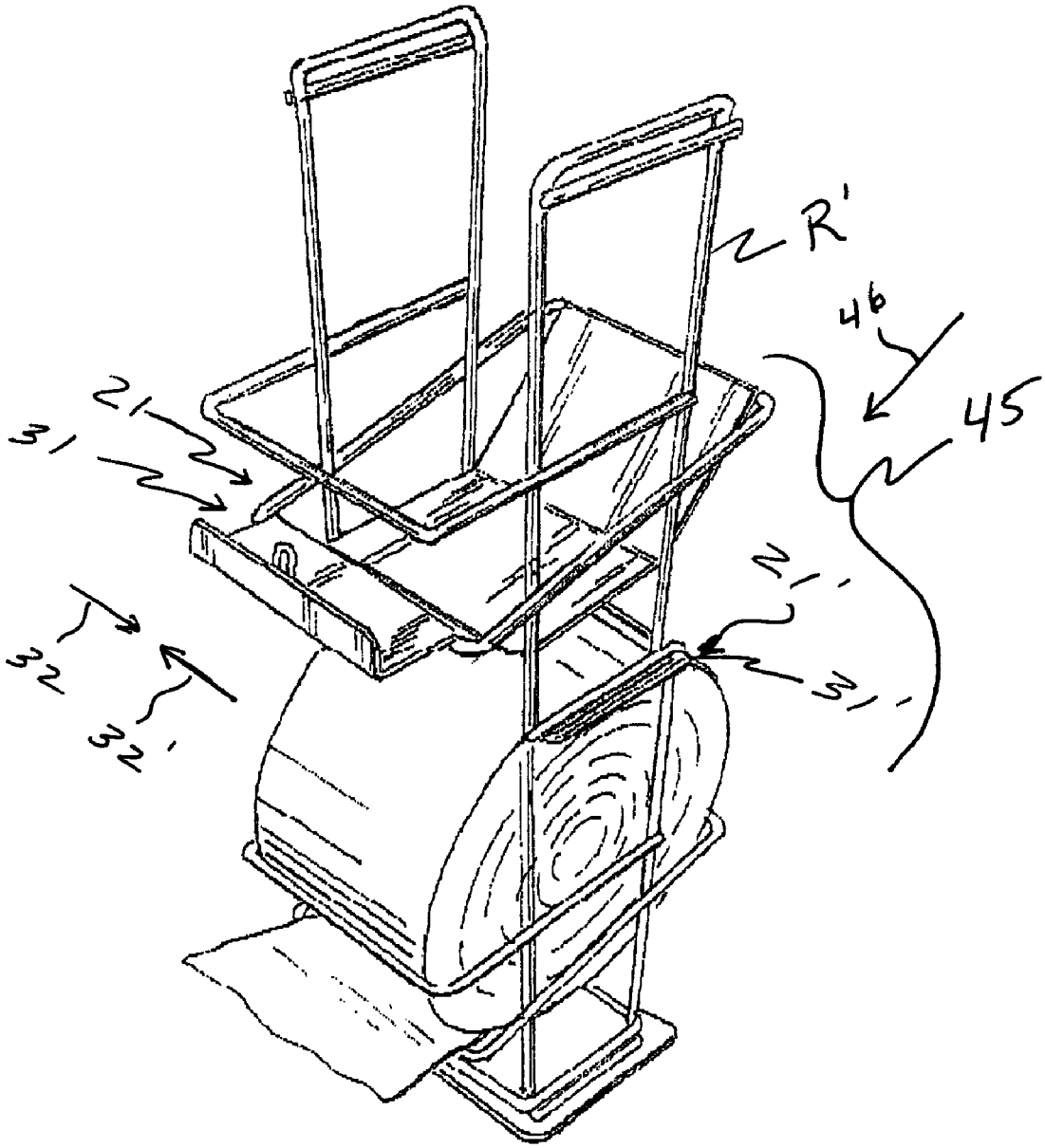
FIG. 3 is an isometric view of the rack of FIG. 2 having a second rack mounted thereupon.

Likewise, continuing with FIGS. 1–3, a second rack R' (in this case, identical to the first rack) can be stacked upon the first discussed rack R by applying pressure 32, 32' to direct the lower ends of the vertical supports of the rack toward one another, and then situating the mounting flanges 31, 31' of the second rack between the engagement slots 21, 21' formed at the upper ends 3', 4' of the vertical supports of the rack R, then discontinuing the application of pressure, allowing the vertical supports to spring 33, 33' back to parallel configuration, lodging the mounting flanges 31, 31' in engagement slots 21, 21', thereby releasable stacking the two racks. A third rack could then be stacked upon the second rack, and so on, as desired.

Continuing with FIGS. 3, 4, 5, and 6, a roll 34 of bags, for example, produce bags, is provided, wherein each bag 35 forming the roll has first 36 and second 37 ends, the first end 36 forming an opening 38 or bag mouth, the second end 37 being sealed 39 to form a bottom, the second end of the first bag being joined to the first end of the next bag to be dispensed via a perforated dispenser line 40 situated laterally across the bag, said line having formed therethrough a medially 42 situated slit 41 for receiving the tongue 17 of the dispenser. The bags may be gussetted or non-gussetted, and may be folded along their length one or more times to provide a roll having a more compact width 43, although folding the bags does increase the diameter 44 of the roll.

Figure 4:
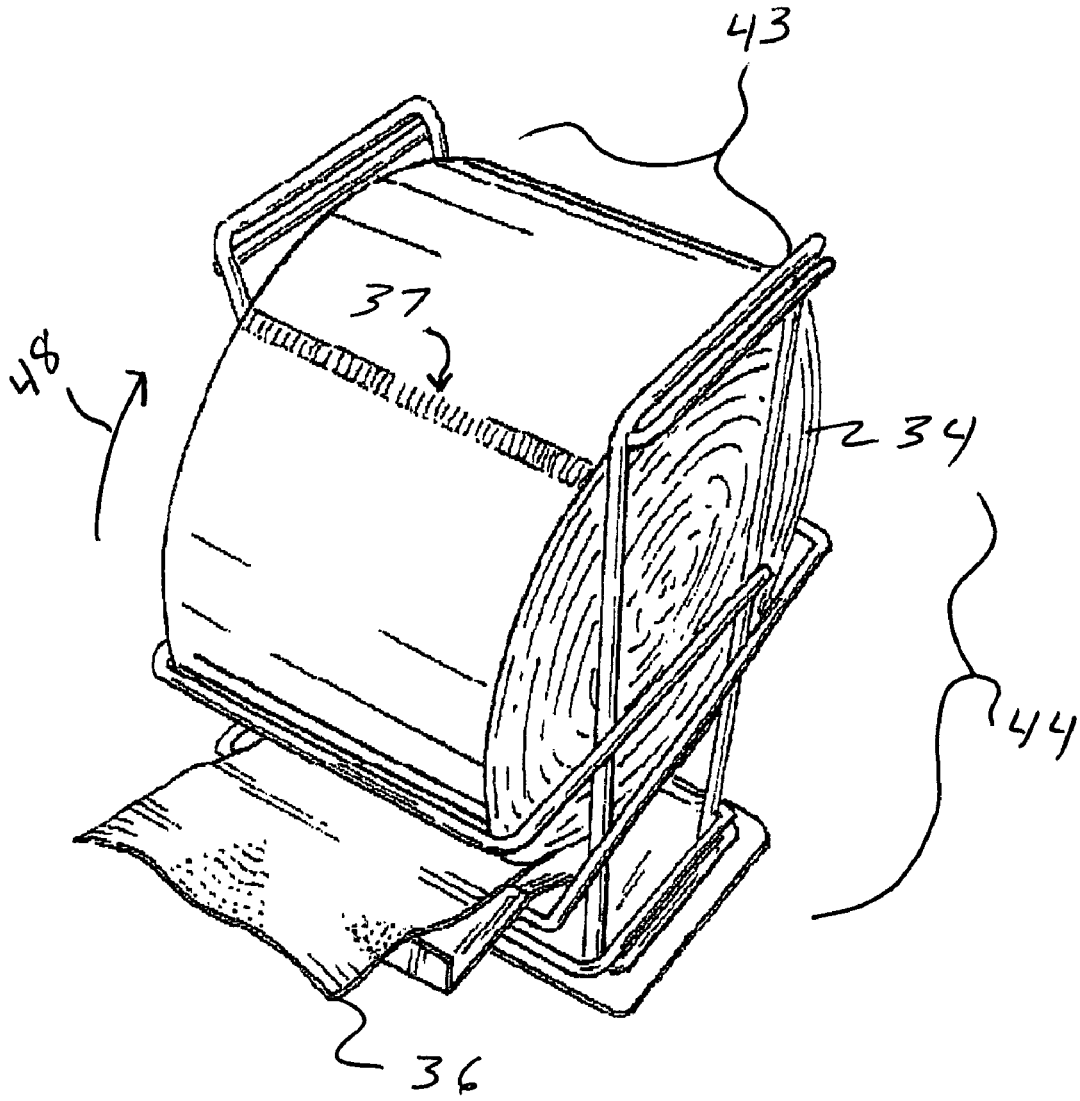
FIG. 4 is an isometric view of the rack of FIG. 2 having a roll of bags situated therein for dispensing.

Referring to FIGS. 1, 3 and 4, the rack R of the present invention is formed such that the space 5 situated between the first 1 and second 2 vertical supports is sufficient to accommodate the width 43 of the bag roll 34, and the space from the cradle 6 supporting the roll (including the rear angled portion 10 of the base plate 7, to the upper ends 3', 4' of the first 1 and second 2 vertical supports is sufficient to allow the passage of a roll therein when there is second rack R' thereupon, thereby providing a rear-feeding option for loading the bag roll into the first bag rack, when there is a second rack stacked thereupon.

To further facilitate ease of installation of a new roll when the racks are in a stacked orientation, the rear angled portion 10 of the base plate 7 is set at a forty five (45) degree angle, which provides optimal cradling of the roll installed in the rack during dispensing, while facilitating ease of installation through 46 the rear of the rack R.

Figure 5:
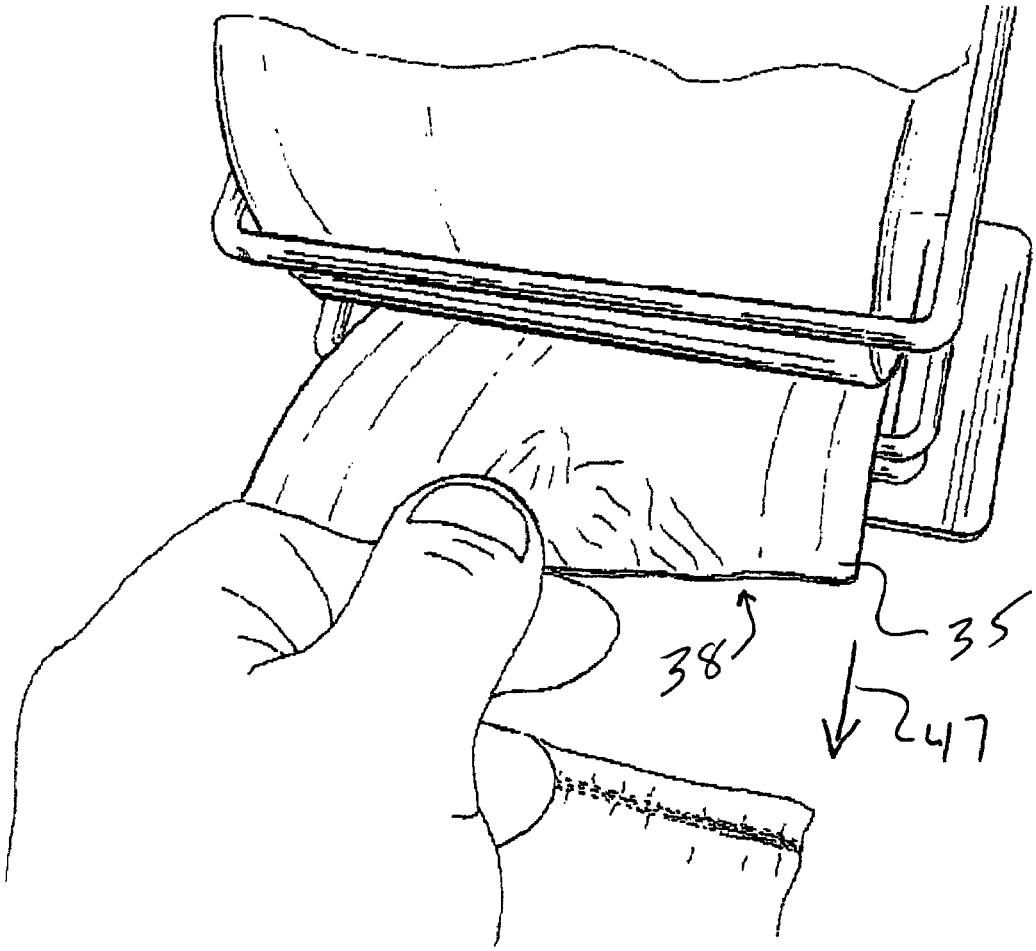
FIG. 5 is a frontal, close-up view of the rack of FIG. 4, illustrating a user pulling the next bag to be dispensed from the roll.
Figure 6:
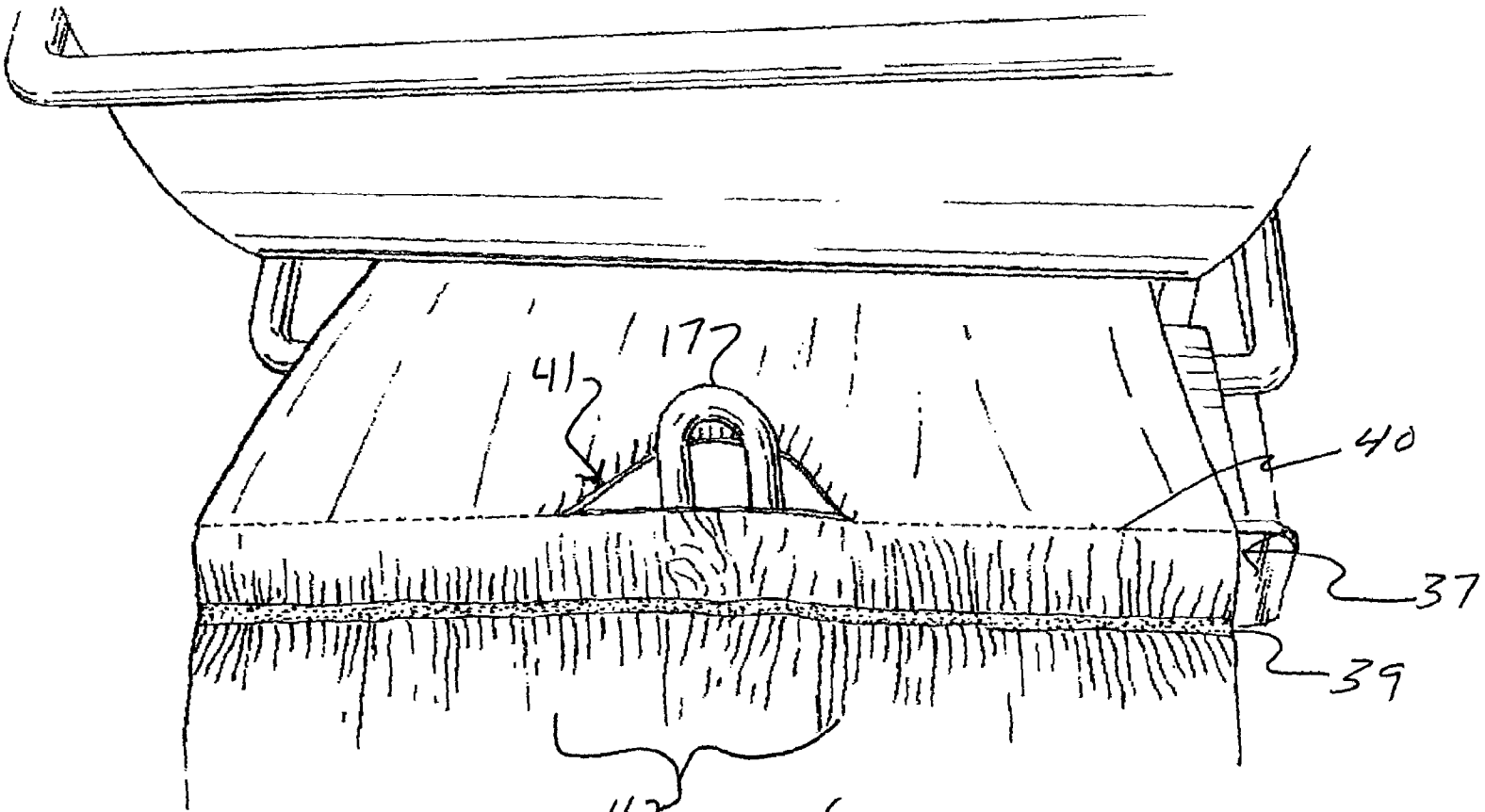
FIG. 6 is an isometric, close-up, upper view the perforated separation line and slot for receiving the tongue of the rack of FIG. 5.
Figure 7:
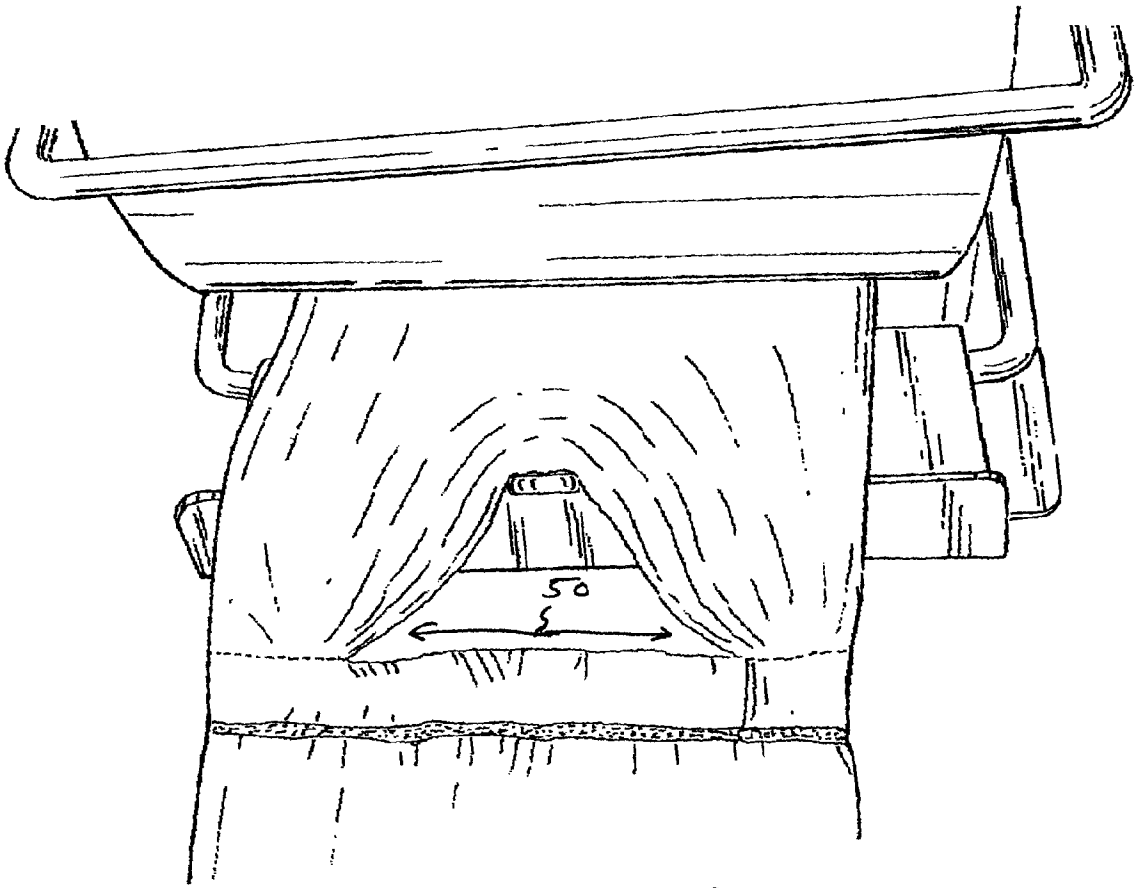
FIG. 7 is an isometric, close-up, upper view of the perforated separation line partially separated, so as to facilitate the dispensing of the bag from the roll.

In use, the rack is installed, one or more racks may then be stacked thereupon in the manner discussed above, the bag rolls placed upon the cradle and the first bag then threaded between the front elevated dispenser portion 11 and the stop bar 13. Referring to FIGS. 4, 5, and 6, the first end 36 of the bag to be dispensed is then grasped then pulled 47, rotating 48 the bag roll 34 upon the cradle (thereby providing frictional anti-overspin means due to friction) until the slit 47 formed in the perforated dispenser line 40 at the second end 37 of the bag engages the tongue 17, anchoring the next bag 49 to be dispensed in place, while tearing 50 the perforated dispenser line, separating the bag being dispensed from the roll.

The method of providing a stacked system of racks may thereby be summarized as follows:

a. providing a rack system for dispensing a roll of bags having a width and a diameter, said roll formed of bags having first and second ends, the bags affixed to one another in series at their respective ends via a lateral tear line, the tear line having formed therein a slit, the rack system comprising:

first and second racks, each comprising:

first and second vertical support members situated in generally parallel fashion, and having lower and upper ends, a length, and a space formed therebetween, said lower end of said first and second vertical support members having first and second mounting flanges formed thereon, respectively;

a cradle formed between said first and second vertical support members, said cradle formed to support the roll of bags;

a dispenser portion forward said cradle for dispensing a bag from said roll of bags;

a stop bar situated above said dispenser portion for retaining the roll of bags on said cradle;

b. applying bias to said first and second mounting flanges of said lower end of said first and second vertical support members of said first rack, so as to facilitate their position adjacent to first and second slots on a mounting base, respectively;

c. releasing said bias to said first and second mounting flanges of said lower end of said first and second vertical support members of said first rack, so as to allow said first and second mounting flanges to engage said first and second slots on said mounting base, providing a mounted first rack;

d. applying bias to said first and second mounting flanges of said lower end of said first and second vertical support members of said second rack, so as to facilitate their position adjacent to first and second mounting slots formed at said upper end of each of said vertical support members of said first rack;

e. releasing said bias to said first and second mounting flanges of said lower end of said first and second vertical support members of said second rack, so as to allow said first and second mounting flanges to engage said first and second mounting slots of said first rack, so as to provide a stacked second rack.

It is reiterated that, although the drawings illustrate first and second racks dispensing the same type of bag, it is intended that the present invention may be utilized to provided stacked racks in a dispensing array for dispensing multiple rolls of bags, whether they be similar or different in size or use, providing customer choice or volume of dispensing product on a small footprint.

A listing of the elements follows:

| Element | Description |
|---|---|
| R | Rack |
| R' | second rack |
| B | Mounting Base |
| 1 | first vertical support |
| 2 | second vertical support |
| 3,' | lower, upper ends |
| 4,' | lower upper ends |
| 5 | space therebetween |
| 6 | cradle |
| 7 | base plate |
| 8 | medial portion |
| 9 | horizontal |
| 10 | rear angled portion |
| 11 | front elevated dispenser portion |
| 12 | support member |
| 13 | stop bar |
| 14 | spaced |
| 15 | extension |
| 16 | end |
| 17 | tongue |

-continued

| Element | Description |
|---|---|
| 18 | medially situated |
| 19 | curved mounting bracket |
| 20 | support bar |
| 21 | slot |
| 22 | mounting plate |
| 23 | apertures |
| 24,' | first and second slots |
| 25,' | brackets |
| 26,' | inward bias |
| 27,' | release |
| 28' | lock in place |
| 29 | engagement sections |
| 30,' | mounting flanges |
| 31,' | mounting flanges (second rack) |
| 32 | directing |
| 33 | spring back |
| 34 | bag roll |
| 35 | bag |
| 36 | first end |
| 37 | second end |
| 38 | opening |
| 39 | sealed |
| 40 | perforated dispenser line |
| 41 | slit |
| 42 | medially |
| 43 | width of roll |
| 44 | diameter" |
| 45 | space for passage of roll |
| 46 | through rear of rack |
| 47 | pulled |
| 48 | rotating |
| 49 | next bag |
| 50 | tearing |

The invention embodiments herein described are done so in detail for exemplary purposes only, and may be subject to many different variations in design, structure, application and operation methodology. Thus, the detailed disclosures therein should be interpreted in an illustrative, exemplary manner, and not in a limited sense.

What is claimed is:

1. The method of dispensing bags, comprising the steps of:

a. providing a rack system for dispensing a roll of bags having a width and a diameter, said roll formed of bags having first and second ends, the bags folded along their length and affixed to one another in series at their respective ends via a lateral tear line, the tear line having formed therein a slit, the rack system comprising:

first and second racks, each comprising:

first and second vertical support members situated in generally parallel fashion, and having lower and upper ends, a length, and a space formed therebetween, said lower end of said first and second vertical support members having first and second mounting flanges formed thereon, respectively;

a cradle formed between said first and second vertical support members, said cradle formed to support the roll of bags;

a dispenser portion forward said cradle for dispensing a bag from said roll of bags;

a stop bar situated above said dispenser portion for retaining the roll of bags on said cradle;

b. applying bias to said first and second mounting flanges of said lower end of said first and second vertical support members of said first rack, so as to facilitate their position adjacent to first and second slots on a mounting base, respectively;

c. releasing said bias to said first and second mounting flanges of said lower end of said first and second vertical support members of said first rack, so as to allow said first and second mounting flanges to engage said first and second slots on said mounting base, providing a mounted first rack;

d. applying bias to said first and second mounting flanges of said lower end of said first and second vertical support members of said second rack, so as to facilitate their position adjacent to first and second mounting slots formed at said upper end of each of said vertical support members of said first rack;

e. releasing said bias to said first and second mounting flanges of said lower end of said first and second vertical support members of said second rack, so as to allow said first and second mounting flanges to engage said first and second mounting slots of said first rack, so as to provide a stacked second rack.

2. The method of claim 1, wherein after step "e" there is provided the additional step "f" of feeding a bag roll between said first and second vertical support members of said first rack, said cradle and said stacked second rack, threading the first bag to be dispensed from said bag roll between a dispenser portion and a stop bar, and pulling said first bag from said rack, allowing said roll to rotate upon said cradle, so as to provide frictional resistance, allowing said stop bar to engage said bag roll to prevent forward migration of said bag roll, and allowing a tongue formed in said dispenser portion to separate said first bag from the bag roll upon said first bag having been removed from the rack.

* * * * *